United States Patent [19]

Yamamoto et al.

[11] 4,055,916

[45] Nov. 1, 1977

[54] EXTERIOR WINDOW UNIT HAVING FRAME HEADER

[75] Inventors: Yukio Yamamoto; Mitsuo Nagase, both of Kurobe, Japan

[73] Assignee: Yoshida Kogyo Kabushiki Kaisha, Tokyo, Japan

[21] Appl. No.: 644,155

[22] Filed: Dec. 24, 1975

[30] Foreign Application Priority Data

Dec. 26, 1974 Japan ..... 50-3881[U]

[51] Int. Cl.[2] ..... E06B 3/26

[52] U.S. Cl. ..... 49/404; 52/97; 52/202; 52/213

[58] Field of Search ..... 52/202, 204, 206, 209–214, 52/97, 738; 49/404, 409–411, 61, 63, 504; 160/90, 91

[56] References Cited

U.S. PATENT DOCUMENTS

| | | | |
|---|---|---|---|
| 2,663,917 | 12/1953 | Peterson | 160/90 |
| 2,842,236 | 7/1958 | Axelrod | 52/97 X |
| 2,916,112 | 12/1959 | Kiehl | 52/202 X |
| 3,055,468 | 9/1962 | Horejes | 52/97 |
| 3,226,779 | 1/1966 | Rust | 49/63 X |
| 3,295,277 | 1/1967 | Potter et al. | 52/211 |
| 3,436,886 | 4/1969 | Nowak et al. | 52/211 X |
| 3,694,961 | 10/1972 | Johnson | 49/504 X |

*Primary Examiner*—Alfred C. Perham

*Attorney, Agent, or Firm*—Hill, Gross, Simpson, Van Santen, Steadman, Chiara & Simpson

[57] ABSTRACT

An exterior window unit for covering the outside of an opening in a building wall. The unit has a frame header comprising a vertical mounting plate, a first horizontal plate projecting outwardly from the mounting plate, a second horizontal plate projecting outwardly from the mounting plate and spaced upwardly of the first horizontal plate, and a slanted surface extending downwardly from said second to said first horizontal plate. The second horizontal plate has at its outer end a drip flange projecting downwardly therefrom.

6 Claims, 1 Drawing Figure

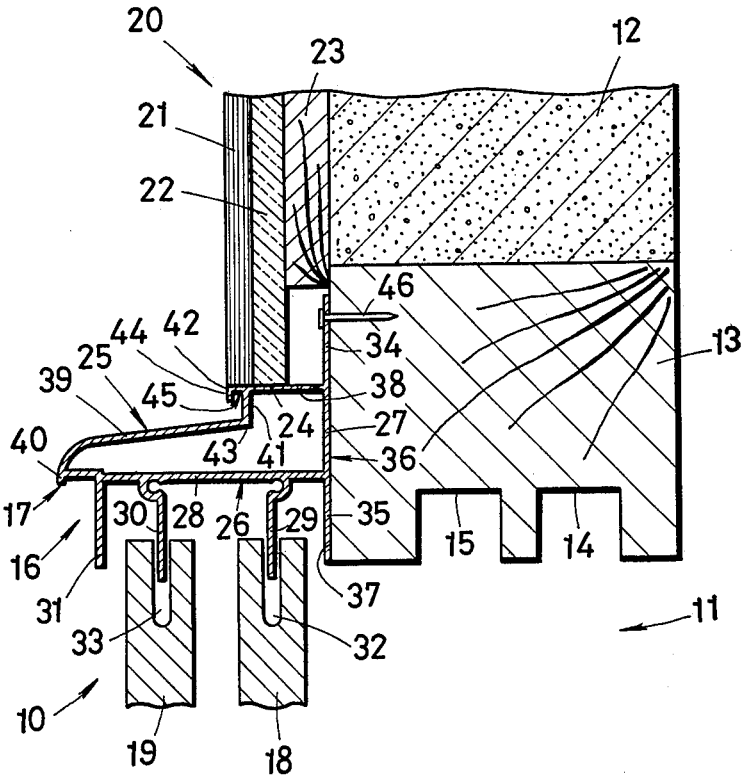
20
23
12
21
22
46
44
42
34
13
25
39
45
38
24
27
40
43
41
36
17
30
28
26
29
35
15
14
16
31
37
11
33
32
10
19
18

EXTERIOR WINDOW UNIT HAVING FRAME HEADER

BACKGROUND OF THE INVENTION

1. Field of the Invention

This invention relates to exterior window units which are to be mounted to cover an opening in a building wall, and having a frame header.

2. Prior Art

Exterior window units have frame headers each including mounting plates to be attached to exteriors of building walls and header plates extending outwardly from the mounting plates and slanted downwardly toward their frontal ends to provide weather resistance. A major difficulty with the prior exterior window units is that exterior siding or decorative wall material attached to the outside of the building walls must be mitered to provide sloped bottom faces or edges which mate neatly with the slanted header plates. Therefore, the preparation and installation of the siding has been tedious and time-consuming.

SUMMARY OF THE INVENTION

It is therefore an object of the invention to provide an exterior window unit which will eliminate the above-noted difficulty.

Another object of the invention is to provide an exterior window unit which will make it possible to attach an exterior siding with maximum ease.

According to the invention, there is provided an exterior window unit having a frame header which comprises a mounting plate adapted to be attached to a wall header and a first plate projecting horizontally outwardly from the mounting plate. A second plate projects horizontally outwardly from the mounting plate for a lesser distance than the first plate and spaced upwardly from the first plate, the second plate being adapted to engage the horizontal bottom edge of an exterior siding on a building wall. A third plate extends outwardly from the second horizontal plate to the first horizontal plate.

Many other advantages and features of the present invention will become manifest to those versed in the art upon making reference to the detailed description and the accompanying sheet of a drawing in which a preferred structural embodiment incorporating the principles of the present invention is shown by way of illustrative example.

BRIEF DESCRIPTION OF THE DRAWING

The drawing is a fragmentary vertical cross-sectional view showing a window unit embodying this invention secured to a header in a building wall.

DETAILED DESCRIPTION OF THE PREFERRED EMBODIMENTS

As shown in the drawing, an exterior window unit 10 is mounted outside of and covers an opening 11 in a building wall having a lintel 12 and a wall header 13 located beneath the lintel 12. The header 13 has in its undersurface a pair of longitudinal parallel grooves 14, 15 in which a pair of inner lapping sashes (not shown) are received for horizontal sliding movement. The exterior window unit 10 comprises a frame 16 made preferably of extruded aluminum and including a frame header 17, and a pair of relatively movable sashes 18, 19 mounted within the frame 16 in parallel closely spaced planes. An exterior wall 20 having a decoration board or siding 21, a thermal insulation board or siding 22, and a foundation board or rough siding 23 is attached to the exterior of the building wall. The lower edges of the decoration board 21 and the thermal insulation board 22 jointly provide a flat horizontal bottom face 24.

The frame header 17 is hollow and comprises an upper portion 25, a lower portion 26 and a connecting portion 27. The bottom portion 25 includes a first or horizontal plate 28 having a pair of spaced longitudinal flanges 29, 30 projecting downwardly from the plate 28, and a longitudinal flange 31 projecting downwardly from the plate 28 and spaced outwardly of the flange 30. The sashes 18, 19 are provided in their top rails with a pair of grooves 32, 33, respectively, into which the flanges 29, 30 extend in order to guide the sliding movement of the sashes 18, 19, respectively.

A pair of vertical fins 34, 35 are formed integrally with the frame header 17 and extend from the connecting portion 27 upwardly and downwardly, respectively, to provide a mounting plate 36 adapted to be attached to an exterior surface 37 of the header 13.

The upper portion 24 includes a second or horizontal plate 38 projecting outwardly from the plate 36 by a lesser amount and spaced upwardly of the first plate 28, a third plate 39 slanted downwardly toward its frontal or outer end 40, and a vertical plate 41 projecting downwardly from the plate 38 at a position adjacent to its outer end 42 and connected to the inner end 43 of the slanted plate 39. The plate 39 may extend horizontally to its outer end 40. Preferably, the width of the horizontal plate 38 is substantially equal to the thickness of the exterior siding or wall 20. The horizontal plate 38 has a drip flange 44 projecting downwardly from its outer end 42 so as to provide flashing 45 constituted by the drip flange 44, the vertical plate 41, and a portion of the plate 38 which extends between the flange 44 and the plate 41.

When the frame header 17 is to be installed, the mounting plate 36 is first brought into contact with the exterior surface 37. The frame header 17 is secured to the header 13 by means of a number of nails 46 which pass through the mounting fin 34 into the header 13. Then, the exterior siding or wall 20 is attached to the building wall 12 with the flat bottom edge or face 24 placed on the horizontal plate 38. With this arrangement, the flashing 45 prevents rain water from penetrating into an area where the bottom face 24 and the horizontal plate 38 are held against each other. Since the frame header 17 has the horizontal plate 38 against which the siding 21, 22 is mounted, the decoration board 21 and the thermal insulating board 22 need not be mitered to provide a sloped bottom face which would otherwise be required to mate with a slanting top header plate. Furthermore, the slanted plate 39 provides good weather resistance.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An exterior window unit for being mounted on the outside of an opening in a building wall, such wall having exterior siding and a wall header extending along the opening, said exterior window unit comprising:

a. a frame;

b. a pair of horizontally movable sashes mounted within said frame in parallel closely spaced planes; and c. said frame including a frame header comprising 1. a vertical mounting plate adapted to be attached to the outside of said wall header,
2. a first plate directly joined to and projecting horizontally outwardly from said mounting plate,
3. a pair of horizontally elongated flanges projecting downwardly from said first horizontal plate into slots in the upper ends of said sashes, respectively, and along which flanges said sashes are individually guided during horizontal movement,
4. a second plate joined to and projecting horizontally outwardly from said mounting plate for a distance overlying only the inner one of said sashes and spaced upwardly from said first plate, said second plate being adapted to engage the horizontal bottom edge of said exterior siding and
5. a third plate extending outwardly and downwardly from said second horizontal plate to said first horizontal plate in overlying relation to at least the outer one of said sashes.

2. An exterior window unit according to claim 1 in which said second horizontal plate has a drip flange projecting downwardly from its outer end toward the upper surface of said third plate.

3. An exterior window unit according to claim 1 in which said third plate is slanted downwardly from said second horizontal plate to said first horizontal plate throughout the thickness of said outer sash.

4. An exterior window header for being mounted on a building wall adjacent to external siding, said header comprising:

a. a horizontal plate having a vertical nailing flange perpendicular thereto at one edge for being secured to the building wall with the upper surface of said plate in flatwise engagement with the lower face of the siding;

b. a slanted plate secured to the horizontal plate adjacent to but spaced from its opposite edge, and extending downwardly therefrom and outwardly beyond said opposite edge, the outward width of said slanted plate exceeding the outward width of said horizontal plate; and c. a drip flange secured to said opposite edge of said horizontal plate and projecting downwardly therefrom toward said slanted plate in overhanging vertically spaced relation to and above said slanted plate.

5. An exterior window header according to claim 4, including a pair of horizontally elongated vertical guide flanges individually adapted to provide guidance for one of a pair of horizontally movable sashes during horizontal movement thereof, said guide flanges being fixedly supported beneath and with respect to said plates, one of said guide flanges being disposed outwardly of said drip flange.

6. An exterior window header according to claim 5 including a second horizontal plate extending beneath and coextensively with said first named and slanted plates and fixed along one edge to said vertical nailing flange and along its opposite edge to the distal edge of said slanted plate, said second horizontal plate supporting said guide flanges along their upper edges.

* * * * *